United States Patent [19]

Moen

[11] 4,345,905

[45] Aug. 24, 1982

[54] MAKING OF CONTAINERS WITH TRI-LAMINATED END WALLS

[76] Inventor: Lenard E. Moen, 7914 Michigan Ave., Whittier, Calif. 90602

[21] Appl. No.: 191,529

[22] Filed: Sep. 29, 1980

Related U.S. Application Data

[63] Continuation of Ser. No. 846,900, Oct. 31, 1977, abandoned.

[51] Int. Cl.[3] ..... B31B 1/46

[52] U.S. Cl. ..... 493/171; 493/131; 493/174

[58] Field of Search ..... 493/171, 174, 168, 167, 493/136, 137, 130–132, 125, 126

[56] References Cited

U.S. PATENT DOCUMENTS

| | | | |
|---|---|---|---|
| 3,029,712 | 4/1962 | Dunn | 493/174 X |
| 3,456,563 | 7/1969 | Roesner et al. | 493/114 |
| 3,513,757 | 5/1970 | DiFrank | 493/131 |
| 3,635,129 | 1/1972 | Cobelo, Jr. | 493/125 X |
| 3,978,774 | 9/1976 | Royal | 493/168 |

*Primary Examiner*—James F. Coan
*Attorney, Agent, or Firm*—Frederick E. Mueller

[57] ABSTRACT

A machine for forming a container with full width 3-ply laminar end walls from a preformed cardboard container body blank having side and outer end wall ply forming panels along the sides and ends of a bottom forming panel and inner end wall ply forming panels extending endwise from the ends of the side wall panels. The machine erects and seals the body blank with a mandrel and forming die to form a finished container by applying glue to selected end wall panel surfaces, folding the inner end wall panels upwardly relative to the side wall panels, and then folding the side and outer end wall panels in succession to upright positions relative to the bottom panel to upstanding side by side positions inwardly of the outer end panel with the confronting end panel surfaces in mutual adhesive bonding contact. The forming die comprises a pair of reciprocable die plates and a set of folding shoe means, including extendable and retractable, all of which elements are actuated in a timed relation to movement of the mandrel into and out of the die cavity.

5 Claims, 26 Drawing Figures

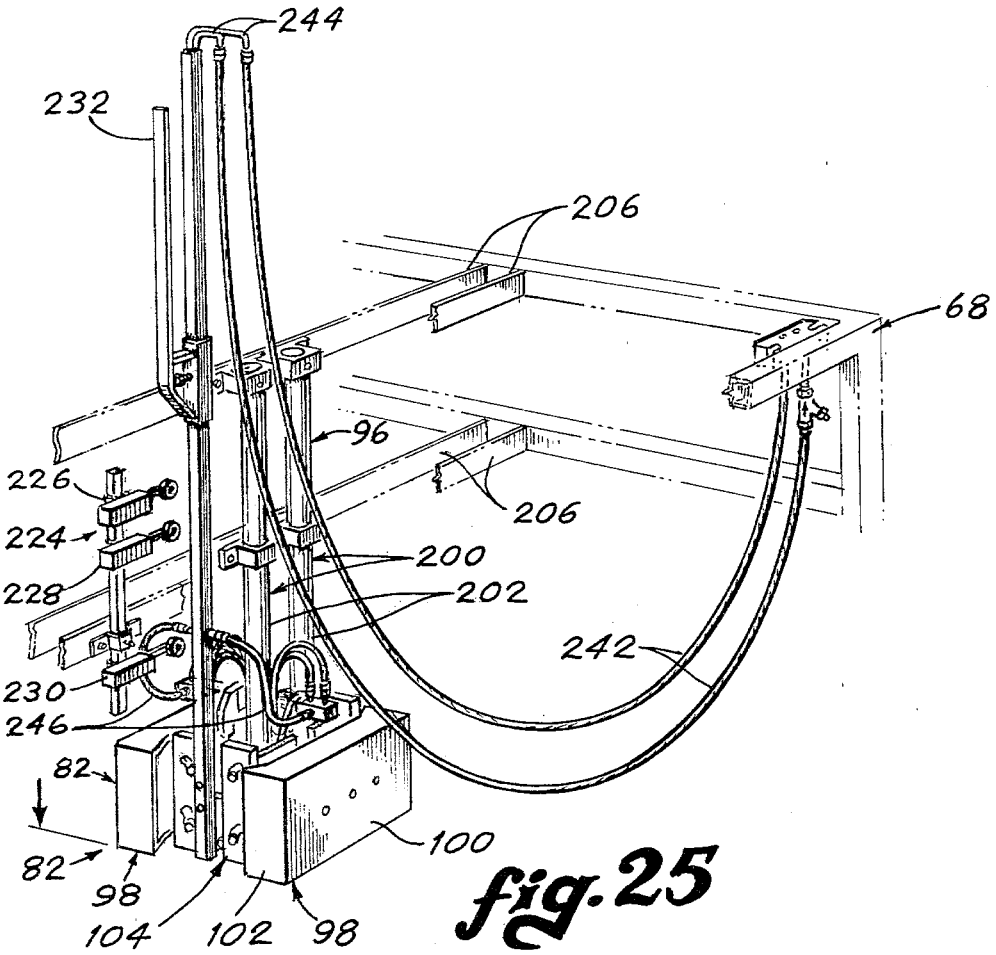
fig. 25
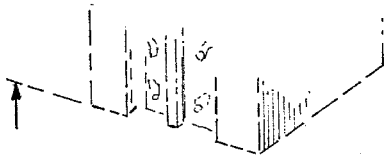

MAKING OF CONTAINERS WITH TRI-LAMINATED END WALLS

RELATED APPLICATION

This is a continuation of Application Ser. No. 846,900 filed Oct. 31, 1977, and now abandoned.

BACKGROUND OF INVENTION

1. Field of the Invention

This invention relates generally to the cardboard container art and more particularly to a novel tray container with full width three ply laminar end walls and to a single preformed body blank from which the entire container is erected. The invention relates also to a novel container forming method and machine for erecting the body blank into a finished container.

2. Prior Art

Containers of the kind to which this invention pertains are intended primarily for use as produce containers, and the invention will be discussed in this context. It will become evident as the description proceeds, however, that the container of the invention is not necessarily limited to this use.

The prior art is replete with a vast assortment of produce containers, container forming methods, and container forming machines. For example, by abandoned application Ser. No. 718,130, filed Aug. 27, 1976 discloses a container forming machine for forming tray containers, Bliss boxes and tray-in-tray containers.

While the tray style produce box is widely used, it has an outstanding deficiency. This deficiency resides in the fact that the box has only single thickness end walls with short inside end wall panels and thus possesses low stacking strength and low resistance to deformation.

Another existing produce container has multiple ply laminar end walls of a sort. Only one outer layer or ply of each end wall, however, extends the full width of the container. The remaining layers or plies of each end wall extend only slightly more than one half the container width and overlap one another only slightly at the center of the end wall. Accordingly, each container end wall effectively has only two layers or plies.

The so called Bliss box has high stacking strength but is a three piece box which must be made in a complex machine having three supply magazines for the separate body and end wall blanks. The machine occupies a relatively large floor area of the packing shed, as does the area for inventorying the supply of separate body and end wall blanks.

SUMMARY OF THE INVENTION

According to one of its aspects, this invention provides an improved tray container made from one piece but having full width three ply end walls. The three plies of each end wall are adhesively bonded together face to face to form a relatively rigid laminar end wall with high compressive strength approaching that of a Bliss box.

In the particular container described, the two inner plies of each end wall have the same height as the container side walls. The remaining outer end wall plies or layers project above the inner plies to form cover flaps which are foldable inwardly to close the open top of the container after the container has been filled. Along the upper edges of the container side walls are sealing flaps which may be folded and sealed over or under the folded cover flaps.

Another aspect of this invention is concerned with a preformed paper board body blank from which the container is erected. This body blank has a rectangular bottom forming panel, side and outer end wall ply forming panels along the sides and ends, respectively, of the bottom panel, and inner end wall ply forming panels extending endwise from the ends of the side wall panels. All of these end wall panels have a length substantially equal to the width of the bottom panel.

The full width three ply laminar end wall container of the invention is formed from this body blank by first applying glue to selected end wall panel surfaces of the blank, and then folding or erecting the blank to its container configuration. This erection procedure involves initial upward folding of the inner end wall panels, selected inner panels first, relative to the side wall panels, followed by upward folding of the side wall panels, and then the outer end wall panels, to upright positions relative to the bottom panel.

As a result of initial upward folding of the inner end wall panels relative to the side wall panels, the inner end wall panels swing inwardly over and downwardly toward the bottom panels into upright overlapping side by side relation along the ends of the bottom panel during upward folding of the side wall panels relative to the bottom panel. These overlapping inner end wall panels form the two inner layers or plies of the container end walls. The outer end wall panels fold upwardly against the outer sides of their adjacent upright overlapping inner end wall panels to form the outer layers or plies of the container end walls.

At the conclusion of the body blank folding or erecting operation, the three contacting end wall panels at each end of the blank are pressed firmly together to effect bonding of the panels to one another. All of the end wall panels extend the full width of the container, thereby the adhesively bonded end wall panels form the full width three ply laminar end walls of the completed container.

A further aspect of the invention is concerned with a container forming machine for practicing the above container forming procedure. This forming machine has an expansible forming mandrel movable into and from a forming die cavity open at its ends. Two opposite sides of this die cavity are formed by extendable and retractable die plates. The two remaining sides of the die cavity are defined by extendable and retractable die shoes. Arranged about the end of the die cavity adjacent the forming mandrel are body blank folding shoes. The forming machine is also equipped with body blank infeed means, container outfeed means, and a glue applicator for applying glue to each body blank.

In operation of the container forming machine, preformed container body blanks are fed edgewise in succession past the glue applicator to an initial forming position, wherein the bottom panel of the blank overlies the forming die cavity. The forming mandrel then extends into the cavity, thereby forcing the body blank into the cavity, bottom panel first. As the blank enters the cavity, the folding shoes about the entrance end of the cavity fold the end and side wall panels of the blank relative to the bottom panel in the sequence and timing discussed earlier to erect the blank to its container configuration.

During this container forming or erecting cycle of the machine, the die shoes of the forming die cavity extend inwardly to force the side wall panels of the erecting body blank against the opposing faces of the forming mandrel. These mandrel faces are tapered in such a way that the side wall panels fold inwardly, slightly beyond normal relative to the bottom panel, to bring the folded inner end wall panels of the blank into proper side by side overlapping relation. Thereafter, the other, non-tapered faces of the forming mandrel expand outwardly, while maintaining parallelism, and the forming die plates extend inwardly to firmly compress therebetween the folded end wall panels of the body blank into firm adhesive bonding contact with one another.

At the conclusion of the container forming cycle of the forming machine, the forming die shoes retract, the forming mandrel contracts, and the forming die plates then retract to release the now completed container. The forming mandrel then retracts from the forming die cavity to receive the next body blank.

BRIEF DESCRIPTION OF THE DRAWINGS

FIG. 25 is a fragmentary perspective view of the forming mandrel and its actuator.

PREFERRED EMBODIMENT OF THE INVENTION

Figure 2:
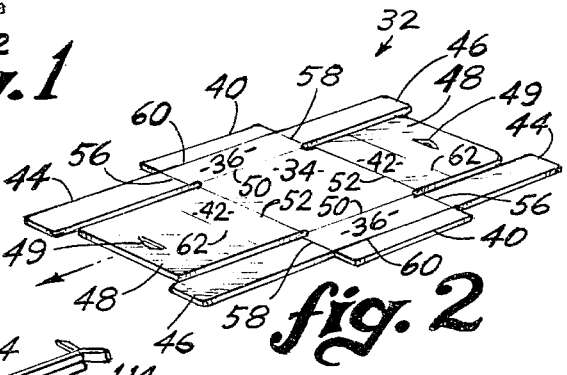
FIG. 2 is an enlarged perspective view of a container body blank according to the invention.
Figure 6:
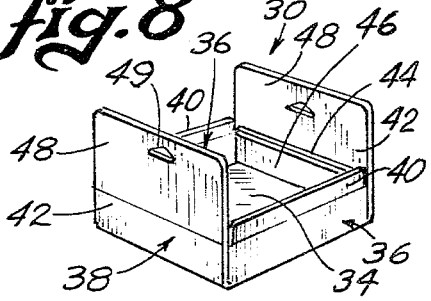
FIG. 6 is a perspective view of the finished container.
Figure 15:
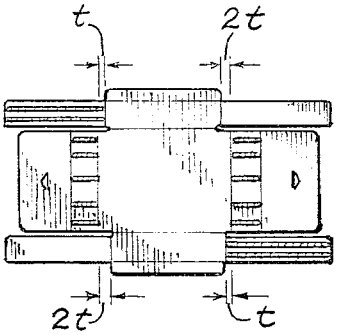
FIG. 15 is a face view on reduced scale, of the container body blank with glue stripes applied to the end panels of the blank.
Figure 16:
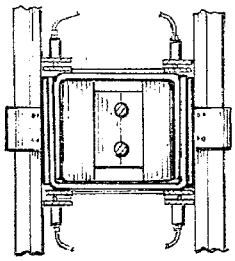
FIG. 16 is a section on reduced scale on line 16—16 of FIG. 14.
Figure 17:
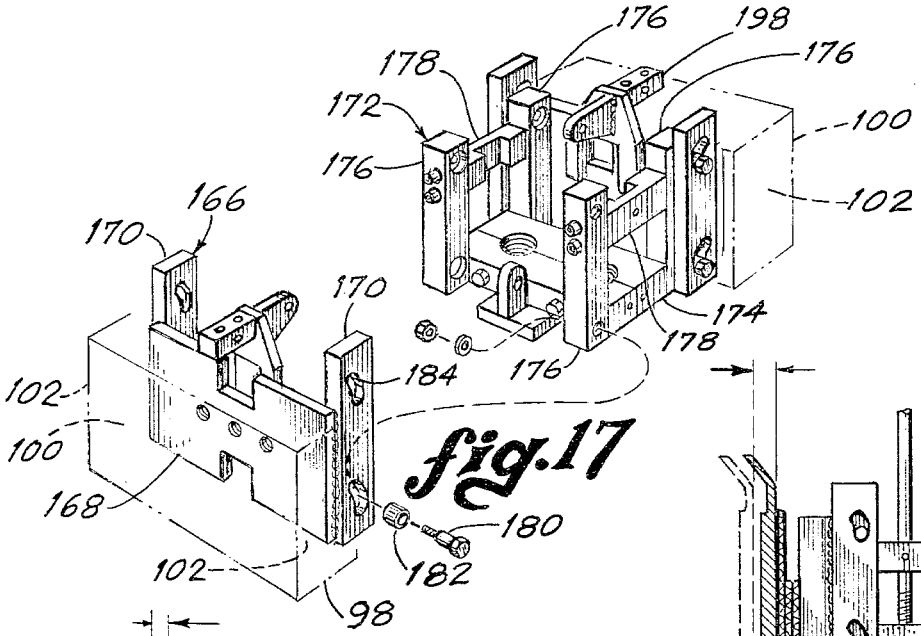
FIG. 17 is an exploded perspective view of the forming mandrel.
Figure 18:
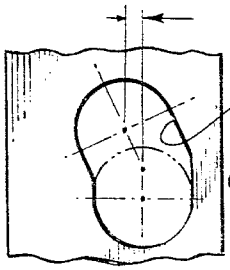
FIG. 18 is an enlargement of a cam slot embodied in the forming mandrel.

Reference is made first to FIG. 6, illustrating a container 30 according to the invention, and to FIGS. 2 and 15, illustrating a preformed paper board body blank 32 from which the container is formed or erected. The container 30 has a rectangular bottom wall or panel 34 and upstanding side and end walls 36, 38 along the sides and ends of the bottom panel. Side walls 36 have a single thickness. Along the upper edge of each side wall is a sealing flap 40. Each end wall 38 has a three ply laminar construction comprising three layers or plies 42, 44, 46 adhesively bonded to one another. The outer end wall plies 42 project above the two inner end wall sides 44, 46 to form cover flaps 48 with hand hold openings 49.

As will be explained later, the container forming machine of the invention produces containers 30 from the container body blanks 32 by folding and erecting the blanks and sealing the folded blanks in the open container configuration illustrated in FIG. 6. After filling, the container is closed by folding either the cover flaps 48 or the side wall sealing flaps 40 over and then the remaining flap, and adhesively bonding these flaps together. If an open top container is desired, the sealing flaps 40 and cover flaps 48 may be eliminated.

The container 30 of FIG. 6, with or without the side and end wall flaps 40, 48, constitutes one important contribution of the invention. The main advantage of this one piece container resides in its three ply laminar end walls 38 whose layers or plies 42, 44, 46 extend the full width of the container between its side walls 36. These full width three ply laminar end walls are relatively rigid and provide the container with increased durability and strength.

In this regard, it is worthwhile to again note that a prior art container exists which is similar to that of FIG. 6 except that its inner end wall plies, which correspond to the plies 44, 46 of the container 30, extend only to slightly more than one half of the width of the container so as to overlap one another slightly at the center of the container end walls. Accordingly, this prior art container has in reality only double ply end walls which are substantially less rigid than the full width three ply end walls of the present container.

The preformed body blank 32 from which the container 30 is formed or erected constitutes another important contribution of this invention. This body blank will now be described by reference to FIGS. 2 and 15.

Body blank 32 is fabricated from a sheet of corrugated cardboard or the like which is scored or creased to form fold lines. These fold lines define portions of the blank which are referred to herein as panels and flaps and are denoted by the same reference numerals as their counterparts in the finished container 30 of FIG. 6.

With this in mind, container body blank 32 has a rectangular bottom forming panel 34, side and end wall forming panels 36, 42 along the sides and ends of the bottom panel, and additional end wall forming panels 44, 46 extending endwise from the ends of the side panels 36. The side and end wall panels 36, 42 are joined to the bottom panel 34 along fold lines 50, 52. End wall panels 44, 46 are joined to the side wall panels 36 along fold lines 56, 58 which are offset from the fold lines 52 distances t and 2t (FIG. 15), where t is the thickness of the blank. Extending across the side wall panels 36 and end wall panels 42 are fold lines 60, 62 which define sealing flaps 40 on the side wall panels 36 and cover flaps 48 on the end wall panels, 42. As noted earlier in connection with the container 30, the sealing flaps 40 and cover flaps 48 may be eliminated if an open top container is desired.

According to the present method of forming a container 30 from the preformed body blank 32, glue stripes 64 are first applied to certain of the end wall panels, in this case panels 42, 44. End wall panels 44, 46 are then folded upwardly relative to the side wall panels 36, about the fold lines 56, 58, with the folding movement of certain of the end wall panels leading that of the other end wall panels. Thereafter, and during continued folding of the end wall panels 44, 46 relative to the side wall panels 36 about the fold lines 56, 58, the side wall panels 36 and end wall panels 42 are folded upwardly relative to the bottom panel 34 about the fold lines 50, 52. The upward folding movement of the side wall panels 36 leads the upward folding movement of the end wall panels 42 and causes swinging of the end wall panels 44, 46 inwardly over and downwardly towards the bottom panel 34 and into side by side overlapping relation approximately along the end wall panel fold lines 52. Upward folding of the end wall panels 42 brings these panels into face to face contact with the folded end wall panels, 44.

This folding procedure is performed in a manner such that the side wall panels 36 and end wall panels 42 assume upright positions relative to the bottom panel 34. The end wall panels 44, 46 assume upright, side by side overlapping positions at the inner sides of the end wall panels 42. End wall panels 44 are disposed between the end wall panels 42, 46 with the confronting panel faces in contact. At this point, the container body blank 32 has been folded or erected to its container configuration of FIG. 6. The end wall panels 42, 44, 46 are then pressed firmly together for a brief period of time to effect adhesive bonding of these panels to one another and thereby completion of container fabrication.

For convenience in the ensuing description, the end wall panels 42 are hereinafter referred to in places as outer end wall panels. The end wall panels 44, 46 are hereafter designated collectively as inner end wall panels and individually as center and innermost end wall panels, respectively.

According to an important feature of the invention, in the course of the above body blank erection procedure, the body blank side wall panels 36 are folded upwardly to positions slightly past normal relative to the bottom panel 34. As will be seen from the later description, this assures folding of the inner end wall panels 44, 46 through their partially folded positions of FIGS. 11 and 12 to their fully folded positions of FIG. 6, wherein the inner end wall panels are disposed in proper side by side overlapping relation at the inner sides of the outer end wall panels 42.

A further important aspect of the invention involves a container forming machine 66 for performing the above container fabrication procedure. This forming machine will now be described.

Referring first in general terms to the container forming machine 66, the latter has a frame 68 mounting infeed means 70 at an infeed station $S_1$ for feeding the container body blanks 32 edgewise in succession through a gluing station $S_2$ to an initial forming position (FIG. 3) at a forming station $S_3$. Mounted on the machine frame 68 at the gluing station $S_2$ is a glue applicator 72 for applying the glue stripes 64 to each body blank passing through the station. Container forming means 74 are provided at the forming station $S_3$ for erecting each body blank to and sealing the blank in its container configuration 30 of FIG. 6. The finished containers discharge from the forming station $S_3$ to an outfeed station $S_4$ containing outfeed means 76 for transporting the containers from the machine.

The primary contribution of this invention resides in the construction and operation of the container forming means 74. Simply stated, this container forming means comprises a forming die 78 defining a vertical rectangular forming die cavity 80 open at its upper and lower ends. A forming mandrel 82 is movable vertically into and from the cavity through its upper end. Forming die 78 comprises a pair of opposing die plates 84 along two parallel sides of the cavity 80. Along the two remaining sides of the die cavity are die shoes 86. Folding shoes 88 are mounted about the upper end of the die cavity 80. Associated with the die plates 84 and die shoes 88 are actuator means 90, 92 for extending and retracting the die plates and die shoes inwardly towards and outwardly away from the die cavity.

Forming mandrel 82 is vertically movable by actuator means 96 through a downward forming stroke into and an upward return stroke from the die cavity 80. The mandrel has a pair of blockers 98 with side faces 100 facing the die plates 84 and end faces 102 facing the die shoes 86. Die plates 84 and blocker side faces 100 are parallel and vertical. Blocker end faces 102 taper inwardly in the upward direction at small angles $\alpha$ relative to the vertical, as shown best in FIG. 13. Embodied in the forming mandrel 82 are actuator means 104 for expanding and contracting the mandrel normal to its blocker side faces 100 by extending and retracting the blockers 98 away from and towards one another.

Figure 3:
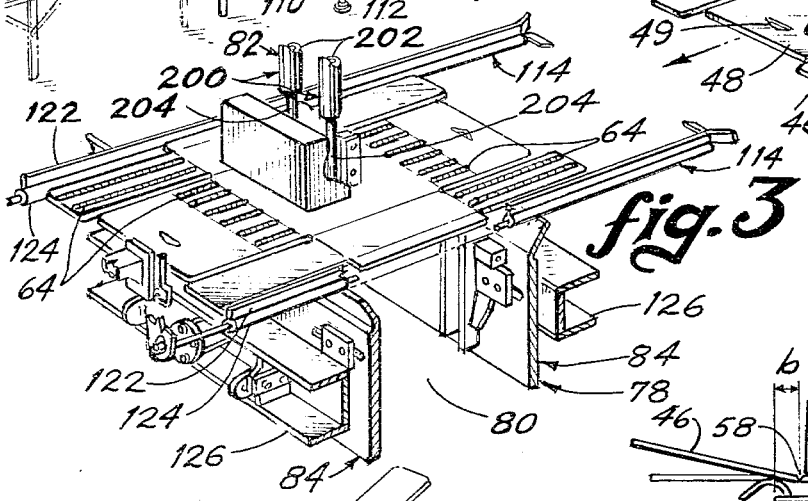
FIGS. 3 through 5 are enlarged fragmentary views of the container forming machine and the body blank illustrating the initial stages in the container forming operation of the machine.

Briefly in operation of the container forming machine 66, container body blanks 32 are fed edgewise in succession by the infeed means 70 from the infeed station $S_1$, through the gluing station $S_2$, to the initial forming position of FIG. 3 at the forming station $S_3$. As each blank travels through the gluing station $S_2$, the glue applicator 72 applies the glue stripes 64 to the end wall panels 42, 44 of the blank in the pattern illustrated in FIGS. 3 and 15. In the initial forming position of each blank, its bottom panel 34 overlies the forming die cavity 80 and underlies the currently upwardly retracted forming mandrel 82, as shown in FIG. 3.

Figure 4:
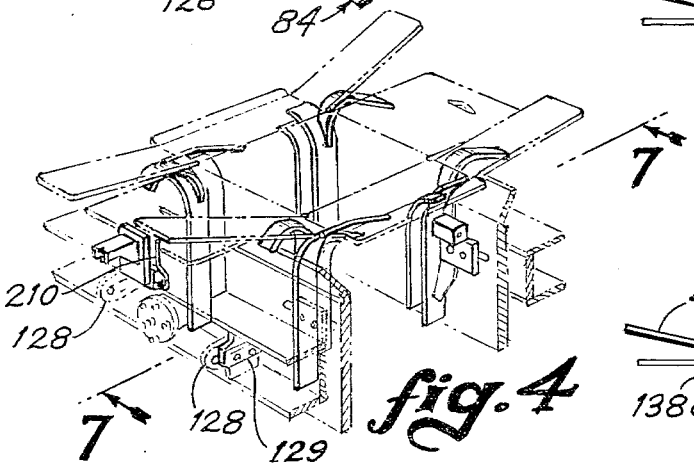

Arrival of each container body blank 32 in its initial forming position at the forming station $S_3$ triggers a container forming cycle of the container forming machine 66. During this cycle, the forming mandrel 82 extends or descends through its forming stroke. The mandrel thereby forces the underlying container body blank 32 into the forming die cavity 80, bottom panel 34 first. This action effects initial upward folding of the body blank inner end wall panels 44, 46, innermost panels 46 first, by the forming die fold shoes 88 as shown in FIG. 4. As the mandrel continues to descend into the forming die cavity 80, the shoes 88 cause upward folding of the body blank side panels 36 and then the end panels 42 relative to the bottom panel 34 and continued inward folding of the inner end panels 44, 46 relative to the side panels.

Figure 11:
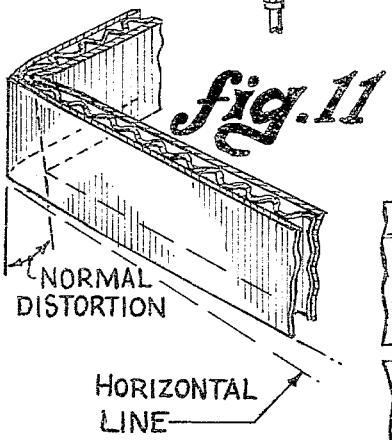
FIGS. 11 and 12 illustrate the container body blank in a partially erected or folded configuration which it occupies at one stage in the operation of the container forming machine.
Figure 12:
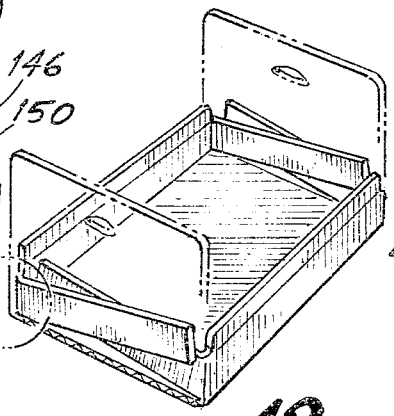
Figure 14:
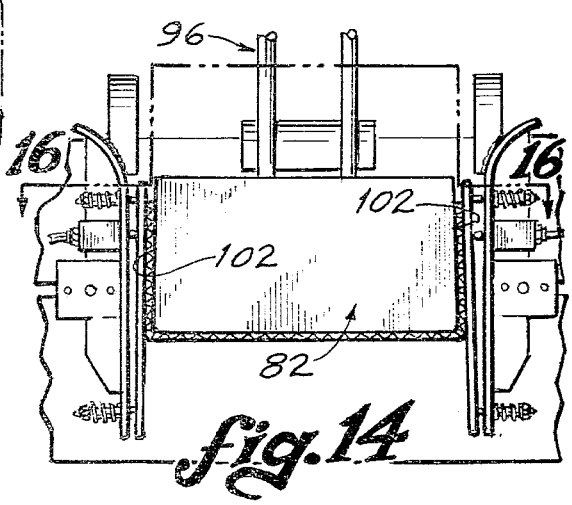
FIG. 14 is a view similar to FIG. 13 with the die cavity shoes extended inwardly to press the side wall panels of the folded body blank against the opposing tapered mandrel faces.

At this point, the container body blank 32 has been erected to its partially folded configuration of FIGS. 11 and 12. The mandrel is in a contracted state and die shoes 86 now extend inwardly to press the body blank side wall panels 36 against the tapered mandrel end faces 102. This action folds the side panels 36 slightly beyond normal relative to the bottom panel 34, as illustrated in FIG. 14, and thereby swings or rotates the inner end wall panels 44, 46 from their partially folded positions of FIG. 12 and forcefully "slaps" them down against the bottom panel 34, to their fully folded positions of FIG. 6. The collapsed state of the mandrel provides clearance for this "slapping" action. The inner end wall panels 44, 46, are thus located in the proper upstanding side by side overlapping relation along the ends of the bottom panel 34 with the upper and lower edges of the inner end panels aligned, as shown. Immediately after extension of the die shoes 86, the forming mandrel 82 expands outwardly towards the die plates 84 and these die plates extend inwardly towards the mandrel to compress the now fully folded end wall panels 42, 44, 46 into firm adhesive bonding contact with one another.

After a short period of time sufficient to assure firm adhesive bonding of the end panels 42, 44, 46 to one another, the forming mandrel 82 is contracted and then retracted upwardly to its initial position of FIG. 3. The forming die plates 84 and die shoes 86 are retracted outwardly to release the now completed container 30. The container then drops downwardly through the open lower end of the forming die cavity 80 into the outfeed station $S_4$ and is transported from the forming machine by the outfeed means 76.

Referring now in more detail to the illustrated container forming machine 66, the machine frame 68 comprises an open rectangular frame structure including vertical frame members 110 at the frame corners and a number of horizontal cross frame members 112 joining the vertical frame members.

The body blank infeed means 70 is essentially conventional and hence need not be described in elaborate detail. Suffice it to say that the infeed means comprises a pair of horizontal rails 114 mounted at an intermediate level on the frame 68 and extending beyond its right hand side in FIGS. 1 and 3. Above the outer ends of these rails is a supply hopper 116 for containing a stack 118 of flat body blanks 32. The blanks in this stack are oriented in the positions shown in FIG. 1 with their end wall panels 44, 46 extending parallel to the rails 114. An infeed kicker 120 feeds the blanks edgewise in succession from the bottom of the stack 118 along the rails 114 to the initial forming position of FIG. 3.

As shown in FIG. 3, each rail 120 comprises an upstanding longitudinal rib 122 along the top of a tube 124. These rails slidably support each container body blank 32 along the outer edges of its side walls 36, or more specifically along the outer edges of the side wall sealing flaps 40. These outer wall or flap edges rest on the rail tubes 124 and engage the ribs 122, which thus confine the blank edgewise in the transverse direction of the rails.

Edgewise infeed movement of each container body blank 32 from the infeed hopper 116 to the initial forming position of FIG. 3 occurs past the glue applicator 72. This applicator applies the glue stripes 64 to the upper surfaces of the outer and intermediate blank end walls 42, 44. Any suitable glue applicator may be used for this purpose. My co-pending application, Ser. No. 003,081, filed Jan. 12, 1979, and entitled Multiple Nozzle Fluid Dispenser for Complex Fluid Delivery Patterns discloses a glue applicator which is particularly suited for use in the present container forming machine. Accordingly, no further description of the glue applicator is necessary.

As noted earlier, in its initial forming position of FIG. 3, each container body blank 32 overlies the forming die 84. This forming die is mounted on a pair of spaced parallel horizontal channels 126 rigid on the machine frame 68 below the inner ends of the infeed rails 114. These channels extend normal to the rails and open outwardly away from one another.

Die plates 84 are vertically disposed along the inner confronting sides of the channels 126. These die plates are supported on the channels for horizontal extension and retraction relative to the channels by longitudinally slotted tongue-like brackets 128 which extend outwardly from the plates through slots in the inner vertical channel side walls and receive guide pins or rollers mounted on supports 129 fixed between the channel flanges.

As noted earlier, die plates 84 are extended and retracted during operation of the container forming machine 66 by die plate actuating means 90. The actuating means 90 for each die plate 84 comprises an air cylinder 130 mounted between the flanges of the corresponding channel 126 midway between the die plate ends. This cylinder contains a plunger (not shown) which engages the outer side of the adjacent die plate through a hole in the inner channel wall. Pressurizing of the air cylinders 130 drives their plungers inwardly against the die plates 84 and thereby extends these plates inwardly towards one another. When the air cylinders are vented, the die plates are retracted outwardly away from one another by springs (not shown).

Figure 9:
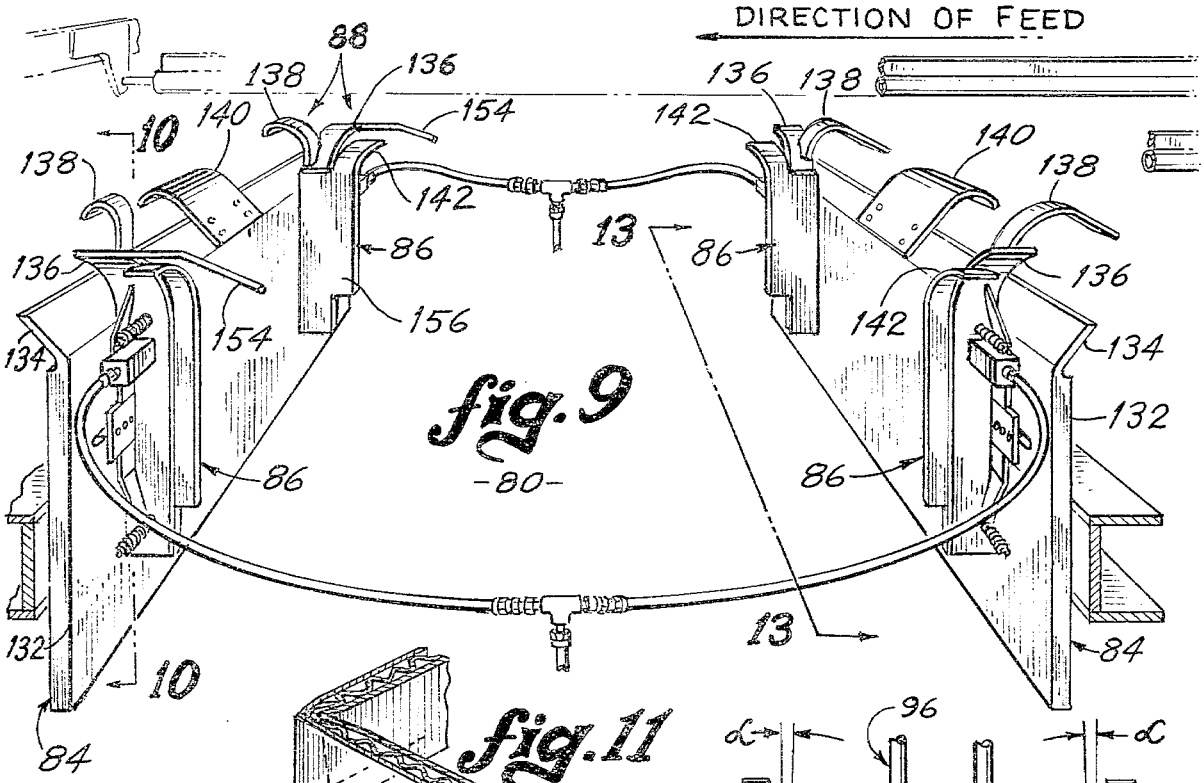
FIG. 9 is an enlarged fragmentary perspective view of the forming die of the container forming machine.

As may be best observed in FIG. 9, each die plate 84 has a major flat lower rectangular portion 132. Along the upper edge of this flat die plate portion is a relatively thin, outwardly inclined cam lip 134.

As noted earlier, the die plates 84 define two parallel vertical sides of the forming die cavity 80. The remaining two sides of this cavity are defined by the die shoes 86. These die shoes are supported by certain of the body blank folding shoes 88. For this reason, these folding shoes will be described first.

Folding shoes 88 comprise a number of separate folding shoes which are designated as follows: side fold shoes 136, corner fold shoes 138, and center fold shoes 140. As described in more detail presently, the die shoes 86 have upper curved portions forming fold shoes 142.

Certain of the fold shoes 88 are located at the leading side of the forming die cavity 80 relative to the direction of infeed movement of the container body blanks 32 to the forming die 78. For this reason, these shoes are hereinafter referred to in places as leading fold shoes. The remaining fold shoes are located at the trailing sides of the forming die cavity relative to this direction of infeed movement and are hereinafter referred to in places as trailing shoes.

Side fold shoes 136 are located at the inner side and adjacent the ends of the die plate 84. Each side fold shoe 136 has a lower flat, relatively narrow plate-like portion 144 disposed in a vertical plane normal to the respective die plate. As shown best in FIG. 10, each side fold shoe 136 curves upwardly and outwardly from the upper end of its lower flat portion 144 in such a way that the shoe curves away from the forming die cavity in directions normal to the infeed rails 114.

Rigid on the outer side of each side fold shoe 136 is a flange 145 which seats slidably against the adjacent die plate 84. Secured to this flange is a mounting block 146. Each side fold shoe 136 is adjustably secured to its adjacent die plate 84 by bolts 148 which extend through the mounting block 146, a slot 150 in the die plate, and a screw plate 152 at the outer side of the die plate. The side fold shoes 136 are thus adjustable lengthwise of the die plates 84. As will appear presently, this side fold shoe adjustment adjusts the effective width of the forming die cavity 80 measured normal to the direction of infeed movement of the body blanks 32.

At the upper ends of the trailing side fold shoes 136, that is the side fold shoes at the trailing side of the forming die cavity 80, are relatively slender rod-like shoe extensions or ramps 154. These ramps extend toward the leading side of the forming die cavity and incline downwardly at small angles, as shown. The purpose of these ramps is to guide or cam the leading edge of each incoming body blank 32 upwardly onto the trailing side fold shoes, as explained in more detail later.

The corner fold shoes 138 extend upwardly from the upper convex sides of the upper curved extremeties of the side fold shoes 136, adjacent the junctions of these curved extremeties with the lower flat shoe portions 144. These corner fold shoes 138 curve upwardly and outwardly away from the forming die cavity in directions generally parallel to the direction of infeed movement of the container body blanks 32, and then downwardly over the upper edges of the die plates 84, as shown best in FIGS. 7 through 9. The two trailing corner fold shoes 138 curve downwardly only a short distance and may terminate above the upper edge of the adjacent, trailing die plate 84. The two leading corner fold shoes, on the other hand, curve downwardly a substantial distance and terminate below the upper edge of the leading die plate 84.

The center fold shoes 140 are two in number and are secured to the upper outwardly inclined cam lips 134 of the die plates 84 midway between the die plate ends. These center fold shoes curve upwardly and outwardly away from the die cavity and then downwardly as shown.

Returning now to the die shoes 86, each die shoe has a lower flat and relatively narrow plate-like portion 156. This lower shoe portion forms the die shoe proper and is located at the inner side of the corresponding lower side fold shoe portion 144. The upper end of each die shoe 86 is narrowed and turns outwardly to form a side fold shoe 142 which curves outwardly away from the forming die cavity alongside and somewhat below the level of the corresponding side fold shoe 136.

Figure 10:
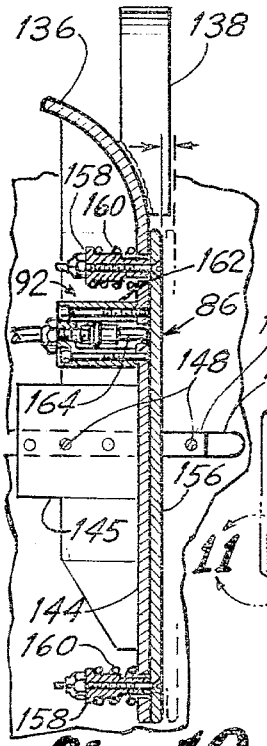
FIG. 10 is an enlarged section taken on line 10—10 in FIG. 9.

Referring particularly to FIG. 10, stud-like elements 158 are secured to the lower portion 156 of each die shoe 86 and extend outwardly through aligned holes in the lower portion 144 of the adjacent side fold shoe 136. Surrounding the outer ends of these studs are springs 160 which yieldably bias the die shoes 36 outwardly into seating contact with their respective side fold shoe portions 144.

Mounted on the outer side of each side fold shoe portion 144 is the corresponding die shoe actuator 92 referred to earlier. This actuator comprises an air cylinder 162 containing a plunger 164. Plunger 164 engages the adjacent die shoe 86 through a hole in the side fold shoe portion 144. Pressurizing of each actuator 92 drives its plunger 164 inwardly against the corresponding die shoe 86 and thereby extends the shoe inwardly toward the forming die cavity. When the actuators 92 are vented, the die shoes 86 are retracted outwardly by the shoe springs 160.

The forming mandrel 82 will now be described in detail by reference to FIGS. 16 through 25. As noted earlier, this forming mandrel comprises a pair of blockers 98 movable apart and together by actuating means 104 to expand and contract the mandrel normal to the blocker side faces 100 while maintaining these faces parallel to one another and to the die plates 84. The blockers have other tapered end faces 102.

Blockers 98 are mounted on frames 166 each having a vertical blocker mounting plate 168 and upright bars 170 along the vertical plate edges. The blockers are bolted or otherwise secured to the mounting plates 168. Between the blocker frames 166 is a mandrel carrier 172. This carrier has a bottom rectangular plate 174 and four upright posts 176 at the four corners of and secured to the plate. The upper ends of the two corner posts at each end of the carrier are joined by a cross-member 178.

The blocker frames 166 are assembled on opposite sides of the mandrel carrier 172 with the bars 170 of each blocker frame straddling the two posts 176 at the adjacent side of the carrier. The blocker frames and carrier are joined by bolts 180 which extend through and mount rollers 182 within cam slots 184 in the frame bars 170. These bolts are threaded in the carrier corner posts 176.

The blocker frames 166 are thus movable vertically relative to the mandrel carrier 172. This vertical movement of the blocker frames causes relative movement of the cam rollers 182 along the cam slots 184. Referring particularly to FIGS. 18 to 21, it will be seen that the cam slots 184 incline toward the vertical center line of the mandrel carrier 172 in the downward direction along the slots and keep the faces 100 of the blockers parallel throughout their expanding and collapsing cycle.

Figure 19:
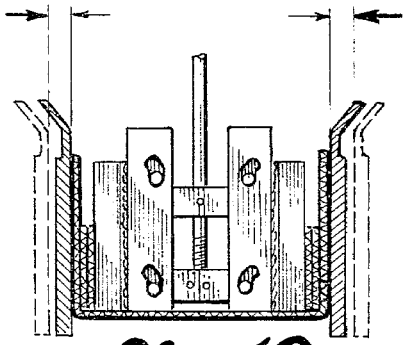
FIGS. 19 through 21 illustrate the expanding and contracting action of the forming mandrel, and the extending and retracting action of the forming die plates to effect firm sealing of the container end wall panels to one another during the container forming cycle and final release of the finished container.
Figure 21:
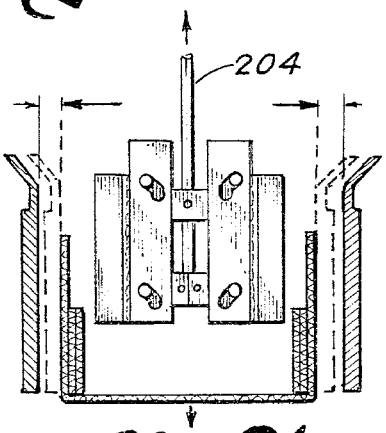
Figure 20:
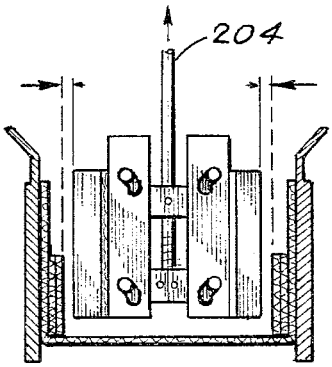
Figure 22:
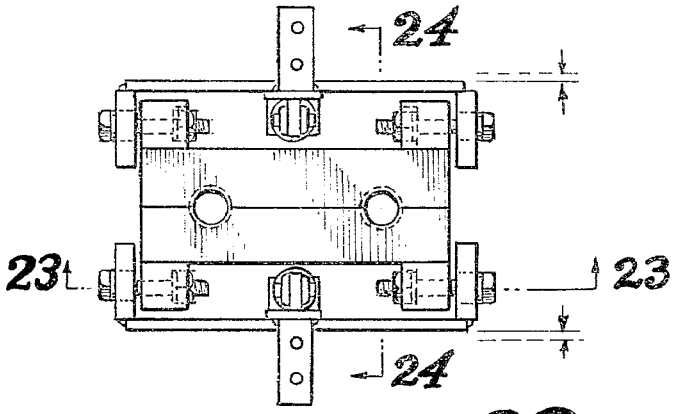
FIG. 22 is a top plan view of the forming mandrel by itself, with certain portions of the mandrel and certain mandrel air lines omitted for the sake of clarity.
Figure 23:
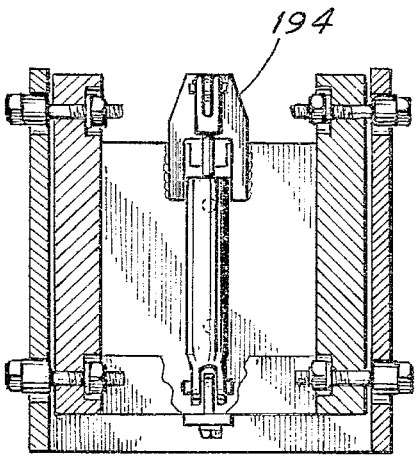
FIG. 23 is a section taken on line 23—23 of FIG. 22.
Figure 24:
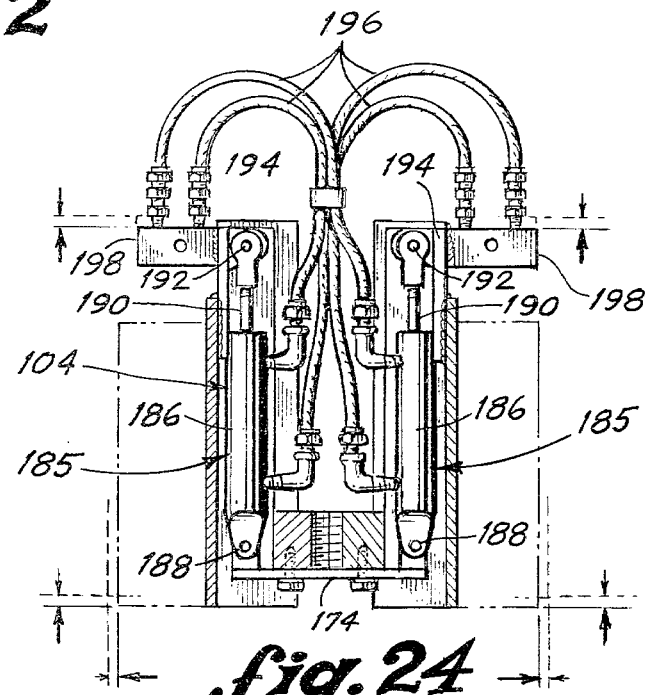
FIG. 24 is a section taken on line 24—24 in FIG. 22 with the mandrel sides or blockers shown in broken lines and the mandrel air lines illustrated in solid lines.

Accordingly, downward movement of the blocker frames 166 relative to the mandrel carrier 172 from the position of FIG. 19 to the position of FIG. 20 causes relative horizontal displacement of the frames and hence the blockers 98 toward one another. This effectively contracts the mandrel 82 normal to the blocker side faces 100. Conversely, upward movement of the blocker frames relative to the mandrel carrier from the position of FIG. 20 to the position of FIG. 19 causes relative horizontal displacement of the frames and blockers away from one another. This effectively expands the mandrel normal to the blocker faces 100. The lower ends of the cam slots 182 are vertical for reasons to be explained presently.

The mandrel camming means just described thus forms part of the actuator means 104 for expanding and contracting the mandrel normal to the blocker faces 100. In addition to this structure, the actuating means 104 comprises double acting air cylinders 185 connected between the blocker frames 166 and the mandrel carrier 172. These actuators comprise air cylinders 186 (FIG. 24) pivotally attached at 188 to the bottom plate 174 of the mandrel carrier. Movable in the cylinders are plungers 190 pivotally attached at 192 to brackets 194 rigid on the blocker mounting plates 168.

From this description, it will be understood that contraction of the air actuators 185 drives the blocker frames 166 downwardly relative to the mandrel carrier 172, thus contracting of the mandrel 82 normal to the blocker faces 100. Extension of the actuators 185 drives the blocker frames 166 upwardly relative to the carrier 172, thus expanding the mandrel normal to the blocker faces 100.

Air lines 196 for the air actuators 185 extend from their cylinders 186 to coupling blocks 198 on the blocker frame brackets 194.

As described earlier, the forming mandrel 82 is driven through its downward container forming stroke and upward return stroke by actuating means 96. This actuating means comprises a pair of vertical, double acting air actuators 200 above the mandrel. Each actuator has a cylinder 202 containing a plunger 204. Cylinders 202 are firmly secured to cross-members 206 on the machine frame 68. Plungers 204 extend downwardly from the lower ends of the cylinders and are threaded in the illustrated bores in the bottom mandrel plate 174. Air is supplied to these actuators through air lines (not shown).

Figure 26:
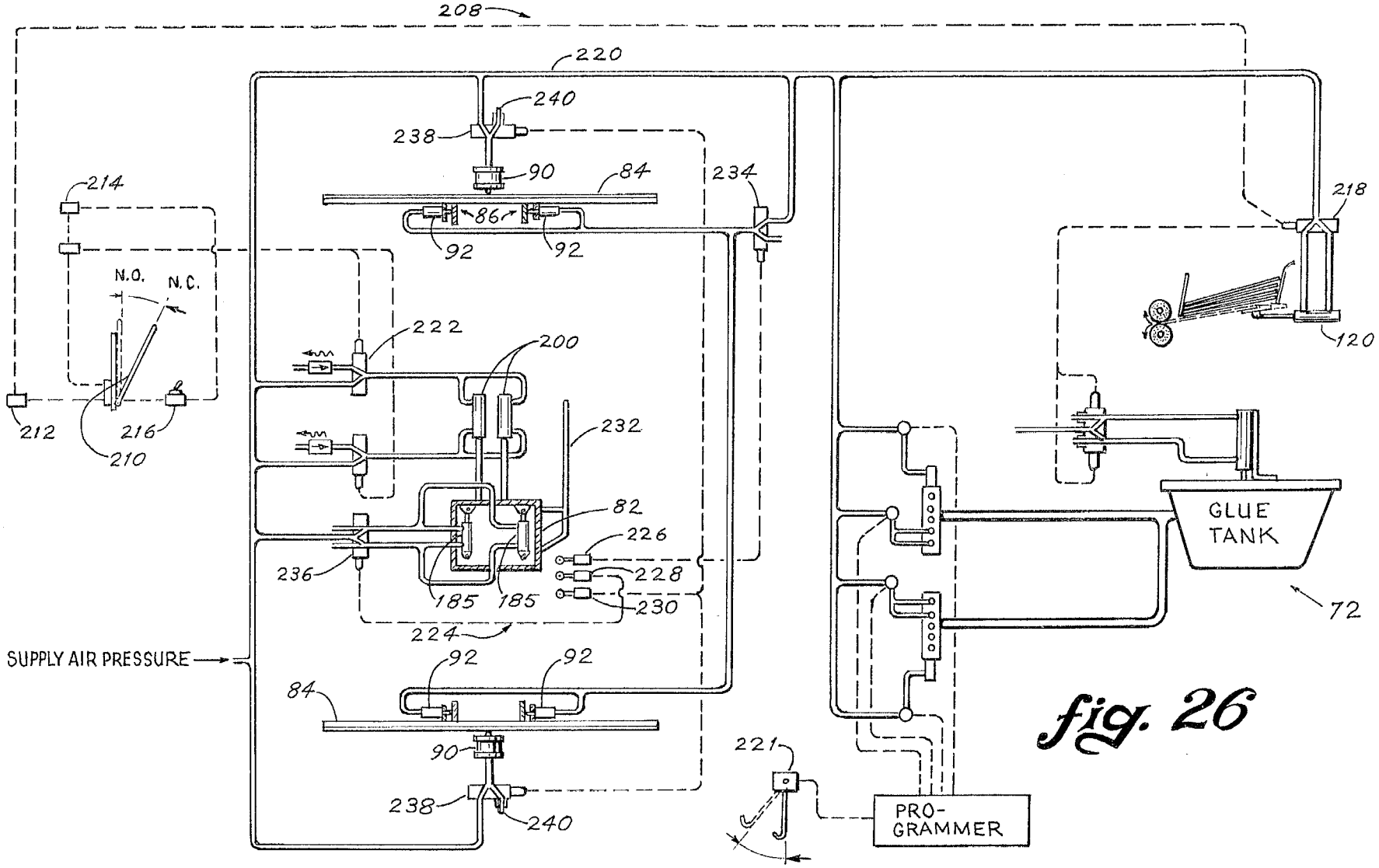
FIG. 26 is a schematic circuit diagram of the container forming machine.

Operation of the container forming machines 66 is controlled by the control system 208 illustrated in FIG. 26. This control system is largely conventional and hence need not be described in elaborate detail. Suffice it to say that the control system embodies a material stop switch 210 which is mounted between the trailing ends of the infeed rails 114 for actuation from its solid line normal state to its broken line actuated state by the leading edge of each incoming container body blank 32 arriving in initial forming position (FIG. 3) over the forming die 78. The infeed kicker 120 and forming mandrel actuators 200 are controlled by resetting timers 212, 214, which are energized through normally closed and normally open contacts, respectively, of the stop switch 210 and a main power switch 216.

Closure of the main power switch 216 with the stop switch 210 in its normal state energizes the kicker timer 212 through the normally closed stop switch contact. This initiates a single timing cycle of the timer 212. During this cycle, the timer actuates a kicker air valve 218 after a preset time delay to supply air to the infeed kicker 120 from a high pressure air line 220. This air pressure operates the kicker to feed a single body blank 32 from the supply stack 118 to initial forming position over the forming die 78.

During its infeed movement through the gluing station $S_2$, the incoming body blank actuates a glue switch 221 which activates the glue applicator 72 to apply the glue stripes 64 to the body blank 32.

Upon arrival of the body blank 32 at its initial forming position over the forming die 78, the leading edge of the blank actuates the material stop switch 210 from its normal state to its actuated state. This actuation of the stop switch 210 opens its normally closed contacts and closes its normally open contacts. Opening of the normally closed switch contacts conditions the kicker timer 212 to reset for the next timing cycle upon return of the stop switch 210 to its normal state. Closing of the normally open stop switch contacts energizes the mandrel timer 214 to initiate a single timing cycle of this timer.

During this timing cycle of the mandrel timer 214, the latter actuates mandrel valves 222 between the actuators 200 and the high pressure air line 220 to first extend the forming mandrel 82 downwardly through its container forming stroke, momentarily retain the mandrel stationary at the lower end of this stroke, and then retract the mandrel upwardly through its return stroke. Downward extension of the forming mandrel 82 through its forming stroke drives the container body blank 32 currently in forming position downwardly into the forming die cavity 80 and hence out of contact with the material stop switch 210. This switch then returns to its normal position with the resultant reopening of its normally open contacts and reclosing of its normally closed contacts. Reopening of the normally open switch contacts conditions the mandrel timer for its next mandrel timing cycle in response to actuation of the material stop switch 210 by the next incoming container body blank.

Reclosure of the normally closed material stop switch contact initiates another timing cycle of the infeed kicker timer 212. During this cycle, the timer 212 again actuates the infeed kicker 120 after a preset time delay to feed another container body blank 32 edgewise to initial forming position over the forming die 78. This time delay of the kicker timer is preset to assure return of the forming mandrel 82 to its upper retracted position at the conclusion of the previous container forming cycle before actuation of the kicker to feed in another container body blank 32.

In addition to the foregoing control elements, the machine control system 208 comprises sequencing switch means 224 operable by movement of the forming mandrel 82 through its container forming and return strokes. Referring to FIG. 25, this sequencing switch means comprises three switches 226, 228, 230 individually adjustably mounted one over the other on an upright support bar fixed to the machine frame 68. The forming mandrel 82 mounts an elongate upright switch target or actuator 232 for actuating the sequencing switches 226, 228, 230 in time sequence as the mandrel descends through its forming stroke and thereafter rises through its return stroke.

Returning to FIG. 26, the upper sequencing switch 226 controls a valve 234 between the die shoe actuators 92 and the high pressure air line 220. Valve 234 normally vents the actuators 82 to allow spring retraction of the die shoe 86. Actuation of switch 226 by the mandrel switch actuator 232 operates the valve 234 to pressurize the die shoe actuators 82 and thereby extend the die shoes inwardly toward the forming die cavity 80 at the time when the body blank is in the partially erected state of FIG. 12.

The middle sequencing switch 228 controls a valve 236 between the mandrel expander actuators 185 and the high pressure air line 220. Valve 236 normally pressurizes the actuators 185 in a direction to contract the forming mandrel 82. Actuation of switch 228 by the forming mandrel switch actuator 232 effects pressurizing of the mandrel actuators 185 in the reverse direction to expand the mandrel.

The lower sequencing switch 230 controls valves 238 between the die shoe actuator 90 and the air line 220. Valves 238 normally vent these actuators through flow restrictors 240 to permit spring retraction of the die plates 84. Actuation of switch 230 by the mandrel switch actuator 232 operates the valves 238 to pressurize the die plate actuators 90. The die plate actuators then drive the die plates 84 inwardly toward one another.

From the foregoing description, it is evident that during each downward forming stroke of the forming mandrel 82, the sequencing switches 226, 228, 230 are actuated in succession to first extend inwardly the die shoes 86, then expand the forming mandrel 82 normal to the die plates 84, and finally extend the die plates inwardly towards the forming mandrel. The switches 226, 228, 230 are disengaged in the reverse sequence during upward return of the mandrel to its upward retracted position. This disengagement of the sequencing switches effects outward retraction of the die plates 84, contraction of the mandrel 82, and retraction of the die shoes 86. Retraction of the die plates 84 is retarded by the flow restrictor 240 for the reasons to be explained presently.

Figure 1:
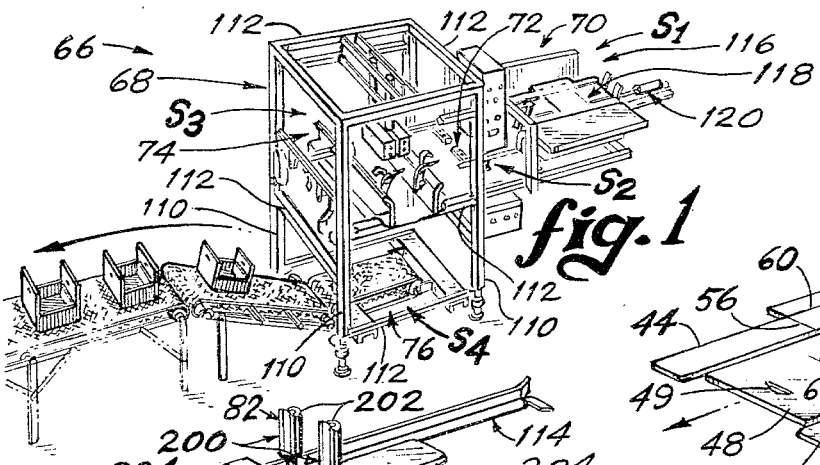
FIG. 1 is a perspective view of a container forming machine according to the invention.

As discussed earlier and explained in more detail presently, each downward forming stroke of the forming mandrel 82 forces into the forming die cavity 80 the container body blank 32 currently in initial forming position. The body blank is thereby folded or erected into and sealed in its container configuration 30 of FIG. 6. Retraction of the die plates 84 at the end of this forming operation allows the container 30 to drop through the open lower end of the forming die cavity 80 onto the outfeed means 76. This outfeed means comprises a series of outfeed conveyers for transporting the containers 30 from the forming machine, as shown in FIG. 1.

The container forming operation of the forming machine 66 will now be explained in detail by reference to FIGS. 2 through 14 and 19 through 21. Each container body blank 32 is initially flat, as shown in FIG. 2. Infeed kicker 120 feeds each container blank edgewise into the machine in the direction of the arrow in FIG. 2 and to the initial forming position of FIG. 3. In this initial forming position, the blank is supported along the outer edges of its side wall panels 36, or more specifically the outer edges of its sealing flaps 40, on the rails 114 and between the rails on the corner fold shoes 138 of the forming die 78. These corner fold shoes engage the inner end wall panels 44, 46 of the blank just outwardly of and quite close to the fold lines 56, 58, as shown best in FIGS. 7 and 8. The bottom panel 34 of the body blank overlies the forming die cavity 80.

It is significant to note here that the upper crests of the corner fold shoes 138 are slightly higher than the upper crests of the side fold shoes 136. The upper crests of the side fold shoes, in turn, are slightly higher than the upper crests of the center fold shoes 140.

Accordingly, as it descends through its forming stroke, the forming mandrel 82 engages the bottom panel 34 of the container body blank 32 currently in initial forming position and forces this bottom panel downwardly into the die cavity 80. This causes the corner fold shoes 138 to exert upward folding pressure on the inner end wall panels 44, 46 of the body blank and thereby fold these panels upwardly about their fold lines 56, 58 relative to the side wall panels 36. The side wall panels and the outer end wall panels 42 initially remain relatively flat.

Figure 5:
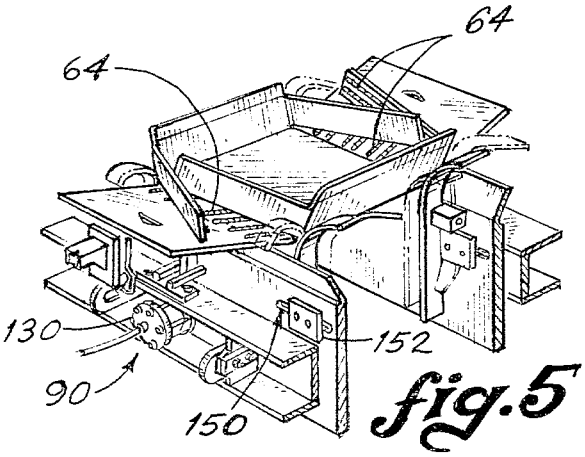

Continued depression of the bottom panel 34 of the body blank into the forming die cavity 80 by the descending forming mandrel 82 causes continued upward folding of the end wall panels 44, 46 relative to the side wall panels 36, and eventually results in contact of the side wall panels 36 with the side fold shoes 136 and thereafter in contact of the outer end wall panels 42 with the center fold shoes 140. Side and center fold shoes 136, 140 now exert upward pressure on the side and end wall panels 36, 42 as the container body blank continues to descend into the die cavity 80. These latter panels are thereby folded upwardly about their fold lines 50, 52 relative to the bottom panel 34 of the body blank, as shown in FIG. 5.

As mentioned above, and illustrated in FIG. 7, the corner fold shoes 138 engage the container inner end wall panels 44, 46 quite close to their fold lines 56, 58. Accordingly, initial downward depression of the container body blank panel 34 into the forming die cavity 80 by the forming mandrel 32 causes relatively rapid upward folding of the end wall panels 44, 46 relative to their side wall panels 36. As a consequence, by the time the side fold shoes 136 engage and commence upward folding of the side wall panels 36 relative to the bottom panel 34, the inner end wall panels 44, 46 will stand upright at relatively large angles relative to side wall panels.

Upward folding of the side wall panels 36 by the side fold shoes 136 thus causes swinging of the folded end wall panels 44, 46 inwardly over and downwardly toward the outer end wall panels 42 which are now just commencing to fold upwardly under the upward pressure of the center fold shoe 140. As shown in FIG. 5, during this inward and downward swinging of the end wall panels 44, 46 the panel portions close to their fold lines 56, 58 engage and ride downwardly along the inner side of the corner fold shoes 138 in the manner best illustrated in FIG. 5. This action causes continued folding of the end wall panels 44, 46 about their fold lines 56, 58, relative to the now upwardly folding side wall panels 36 and towards positions normal to the latter panels. As a consequence, upward folding of the side wall panels 36 causes inward and downward swinging and continued inward folding of the inner end wall panels 44, 46 into generally endwise overlapping upstanding side by side relation along the ends of the bottom panel 34. Near the conclusion of the container forming stroke of the mandrel, the outer end wall panels 42 undergo their final upward folding movement relative to the bottom panel 34 to final upright positions against the outer sides of the overlapping inner end wall panels 44, 46.

From the description to this point, it will be understood that each container body blank 32 is fed edgewise in flat condition to initial forming position over the forming die 78. The body blank is then forced into the die cavity 80 by the forming mandrel 82 and is thereby folded or erected approximately to its container configuration of FIG. 6.

The container end wall panels 42, 44, 46 obviously must be folded in the proper sequence and timing for adhesive bonding of the contacting panels to one another by their glue stripes 64. In this regard, it will be seen in FIGS. 3 and 5 that with the particular glue stripe pattern illustrated, the body blank end wall panels 44 must be folded to positions between the end wall panels 42 and 46.

Figure 7:
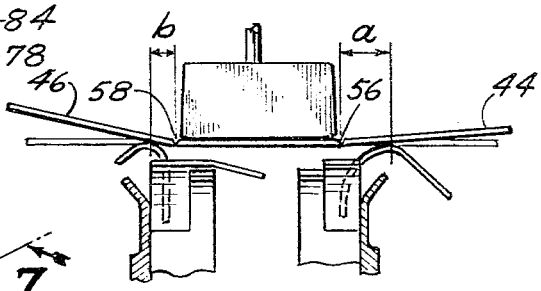
FIG. 7 is a section taken on line 7—7 in FIG. 4.

FIG. 7 illustrates the preferred fold shoe arrangement for retaining the proper folding sequence. In this preferred arrangement, the two corner fold shoes 138 for the two diagonally opposed container end wall panels 44 are shaped to engage these panels a common offset distance A (FIG. 7) from the panel fold lines 56. The two corner fold shoes for the remaining two diagonally opposed end wall panels 46 are shaped to engage these panels a common offset distance B (FIG. 7) from the panel fold lines 58.

It is evident that if the offset distances A, B were equal, the end wall panels 44, 46 would fold at the same speed and through the same angle relative to the side wall panels 36 during depression of the container body blank 32 into the forming die cavity 80 in the manner explained earlier.

Assume now that the offset distances A, B differ. These differing offset distances will cause the end wall panels 44 or 46 with the smaller offset distance to initially fold up relative to their side wall panels 36 more rapidly than the end wall panels with the larger offset distance during initial depression of the container body blank into the forming die cavity 80 by the forming mandrel 32. Moreover, as may be readily observed in FIGS. 7 and 9, the inner, die cavity facing sides of the corner fold shoes 138 with the smaller offset distance will have a greater slope than the inner sides of the corner fold shoes with the greater offset distance. As a consequence, the end wall panels engaging the corner fold shoes with the smaller offset distance will fold more rapidly than the end wall panels engaging the corner fold shoes with the larger offset distance. Hence, the folding movement of the former end wall panels will lead the folding movement of the latter end wall panels.

This differential folding action is utilized in the container forming machine 66 to effect folding of the body blank end wall panels 42, 44, 46 in the proper timing and sequence to produce the finished container structure 30 of FIG. 6. To this end, the two diagonally opposed corner fold shoes 138 for the innermost end wall panels 46 of the container body blank 32 are provided with the smaller offset distance B in FIG. 7. As a consequence, the folding movement of the end wall panels 46 will lead the folding movement of the end wall panels 44 during erection of the container body blank 32 during its depression into the forming die cavity 80 by the forming mandrel 82. The end wall panels 46 will thus fold to positions to the inner sides of the lagging end wall panels 44. As noted earlier, the folding movement of the end wall panels 42 lags the folding movement of both the end wall panels 44, 46. Accordingly, the end wall panels 42 fold upwardly against the outer sides of the end wall panels 44. The end wall panels 42, 44, 46 thus become the outer, center, and innermost layers or plies of the container end walls 38. This is the proper arrangement or sequence of the plies for adhesive bonding thereof by the glue stripes 64.

Figure 8:
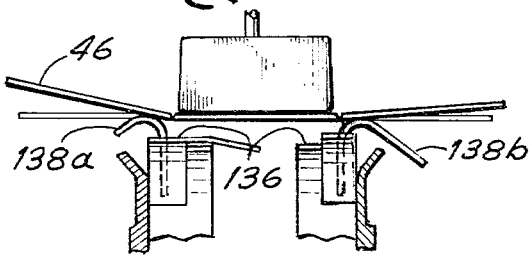
FIG. 8 is a view similar to FIG. 7 illustrating a modification of the invention.

Differential folding of the end wall panels 44, 46 may be also accomplished by placing the corner fold shoes 138 A for the leading fold end wall panels 46 at a higher elevation but at the same offset distance as the corner fold shoes 136 B for the trailing fold end wall panels 44, as shown in FIG. 8. This tends to produce on the body blank 32 a twisting movement about an axis normal to the blank which must be resisted in order to retain the blank in the proper forming position relative to the forming die 78. It is for this reason that the corner fold shoe arrangement of FIG. 7, wherein the corner fold shoes 138 are at the same elevation but have different offset distances, is preferred.

The overall operation of the forming machine 66 will now be described. During this operation, the infeed kicker 120 is operated periodically by the kicker timer 212 to feed container body blanks 32 edgewise in succession from the supply stack 118, past the glue applicators 72, to initial forming position over the forming die 78. The downturned ends on the leading corner fold shoes 138 and the downwardly inclined extensions or ramps 154 on the trailing corner fold shoes serve to guide or cam the leading edge of each incoming body blank upwardly over the die plates 84 and onto the corner fold shoes.

As each body blank 32 arrives in initial forming position, its leading edge depresses the material stop switch 210 to initiate a single timing cycle of the mandrel timer 214. During this cycle, the mandrel actuators 200 are pressurized to drive the mandrel 82 downwardly through its container forming stroke. The container body blank 32 currently in initial forming position is thereby forced, bottom panel 34 first, into the forming die cavity 80 to fold or erect the blank to its container configuration of FIG. 6. As the mandrel descends through the die cavity, the mandrel sequencing switches 226, 228, 230 are operated in succession by the switch target or actuator 232 on the mandrel.

Figure 13:
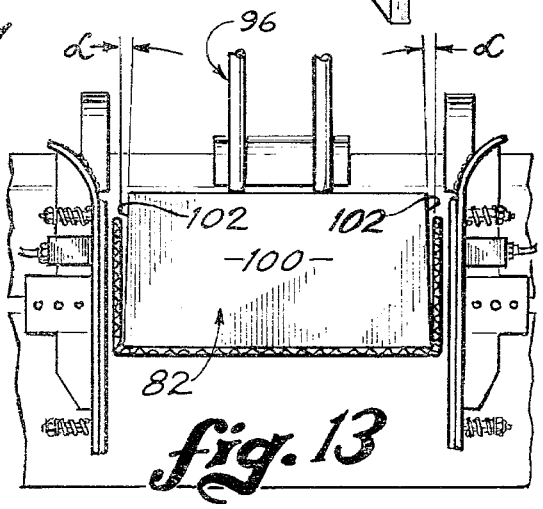
FIG. 13 is a view on reduced scale, taken on line 13—13 of FIG. 9, with the forming mandrel and partially folded container body blank within the forming die cavity and showing the die cavity shoes in retracted position.

Sequencing switch 226 is operated first, after the container body blank 32 has been depressed all the way into the die cavity 80. At this stage, the body blank will have been erected to a partially folded configuration somewhat like that shown in FIGS. 11 and 12. In this partially folded configuration, the end wall panels 44, 46 incline upwardly out of contact with the bottom panel 34 and in crossing relation to one another owing to the fold line distortion illustrated in FIG. 11. Operation of the sequencing switch 226 pressurizes the die shoe actuators 92 to extend the die shoes 86 inwardly toward the descending forming mandrel 82, as shown in FIGS. 13 and 14. This action presses the container side wall panels 36 inwardly against the tapered end faces 102 of the forming mandrel 82, thereby folding the side wall panels inwardly slightly past normal relative to the bottom panel 34. The end wall panels 44, 46 are thereby swung or rotated downwardly from their positions of FIGS. 11 and 12 to their fully folded positions of FIG. 6. In these fully folded positions, the end wall panels 44, 46 are disposed in proper upstanding, side by side overlapping relation with their upper and lower edges aligned, as shown in FIG. 6.

Sequencing switch 228 is actuated by the switch actuator 232 immediately after the above actuation of the die shoes 86. Operation of switch 228 extends the mandrel expansion/contraction actuators 185 to expand the descending mandrel 82 outwardly toward the die plates 84. Immediately thereafter, sequencing switch 230 is actuated to pressurize the die plate actuators 92 and thereby extend the die plates 84 inwardly toward the forming mandrel 82. This outward expansion of the forming mandrel 82 and inward extension of the die plates 84 acts to compress the container end wall panels 42, 44, 46 into firm adhesive bonding contact with one another.

The mandrel timer 214 retains the mandrel 82 at the lower end of its forming stroke for a brief period of time sufficient to accomplish firm adhesive bonding of the end wall panels 42, 44, 46 to one another. The timer then effects reverse pressurization of the mandrel actuators 200 to retract the mandrel upwardly through its return stroke. As the mandrel rises, the switch actuator 232 releases the sequencing switches 226, 228, 230 in reverse order to permit spring retraction of the die plates 84, effect contraction of the mandrel 82, and permit spring retraction of the die shoes 86.

The flow restrictors 240 for the die plate actuators 90 retard spring retraction of the die plates until the ascending forming mandrel 82 has contracted out of contact with the end wall panels 46 of the just formed container 30. This retains the die plates in gripping contact with the container until the mandrel has fully released the container to prevent the latter from adhering to and rising with the mandrel. The die plates then retract to release the container which then drops from the forming die cavity 80 onto the outfeed conveyers 76.

Depression of each container body blank 32 into the forming die cavity 80 releases the material stop switch 210 which then returns to normal position and restarts the infeed kicker timer 212. After a time delay sufficient to assure full upward retraction of the forming mandrel 82, the kicker timer 212 again actuates the infeed kicker 120 to feed in another container body blank 32 and thereby initiate a new container forming cycle of the machine.

As shown in FIG. 25, the forming mandrel expansion/contraction actuators 185 are supplied with high pressure air and are vented through air lines 242 which extend from the machine frame 68 to the upper end of the sequencing switch target 232, air tubes 244 which extend downwardly through the target, and air hoses 246 which connect the lower ends of the air tubes 244 to the actuator air lines 196 through the coupling box 198. The air lines 242 are provided with sufficient slack to permit free movement of the forming mandrel 82 through its forming and return strokes.

It will now be apparent to those skilled in the art that the machine and its mode of operation have novel features of utility in machines for making containers of configurations other than the tri-laminated container 60. The mandrel 82, for example, with its means for expanding and contracting while maintaining its faces 100 in parallelism may be used to great advantage in Bliss box, tray-in-tray or conventional tray machines. For tray machines generally the herein disclosed arrangement for folding side wall panels slightly past normal, relative to the bottom panel to "slap" the end wall panels into proper alignment, is highly significant.

I claim:

1. A machine for forming a container from a preformed paperboard body blank having a rectangular bottom panel, side wall panels along and substantially co-extensive with the two sides of said bottom panel, first end wall panels along and substantially co-extensive with the two ends of said bottom panels, and two pairs of additional end wall panels extending endwise of said side panels from the ends of the latter panels and each having a length approximating the width of said bottom panel, said machine comprising:

a forming die defining a forming cavity of substantially the same rectangular cross-section as said body blank bottom panel, a substantially rectangular forming mandrel movable longitudinally through a forming stroke into and a return stroke from said cavity through said one end of the cavity, said forming die being adapted to receive said body blank in an initial forming position, wherein said bottom panel of the blank overlies said one end of said cavity, whereby movement of said mandrel through said forming stroke forces said body blank into said cavity bottom panel first, said forming die including folding shoe means about said one end of said forming cavity whose positions relative to said cavity remain fixed during said forming stroke of said forming mandrel, said folding shoe means comprising die shoes defining the two parallel sides of said forming cavity which parallel the sides of said body blank bottom panel, actuator means for extending and retacting said die shoes toward and away from said cavity, said forming die including parallel die plates defining the two remaining sides of said cavity, said folding shoe means being disposed to engage said end wall panels of said body blank in said initial forming position of the bank in such manner that during movement of said blank into said cavity by said mandrel, said folding shoe means effect upward folding of said additional end wall panels relative to said side wall panels in a sequence of one pair after the other pair of said additional end panels, followed by simultaneous continued folding of said additional end wall panels relative to said side wall panels and concurrent upward folding of said side wall panels to upright positions relative to said bottom panel, whereby said additional end wall panels swing inwardly and downwardly to upright side by side overlapping positions along the ends of said bottom panel, and final upward folding said first end wall panels to upright positions relative to said bottom panel, whereby said additional end wall panels swing inwardly and downwardly to upright side by side overlapping positions along the ends of said bottom panel, and final upward folding said first end wall panels to upright positions relative to said bottom panel to form a container configuration wherein said end wall panels were disposed in upright side by side contacting relation along the ends of said bottom panel extending the full width of said bottom panel to form full width three ply laminar end walls of said container configuration, means for operating said actuator means to extend said die shoes in timed relation to movement of said forming mandrel for pressing said body blank side wall panels against the opposing side faces of said mandrel, said mandrel side faces converging upwardly in such a way that pressing of said body blank side walls against said mandrel faces by extension of said die shoes folds said side wall panels slightly past normal relative to said bottom panel to press said additional end wall panels edgewise firmly against said bottom panel, actuator means for extending and retracting said die plates toward and away from one another in timed relation to movement of said forming mandrel, actuator means for expanding and contracting said mandrel normal to said die plates, and means for operating said die plate and mandrel actuator means to extend said die plates and expand said mandrel in timed relation to the mandrel movement for pressing the folded bottom blank end wall panels between said mandrel and die plates.

2. The container forming machine according to claim 1 wherein:

said folding shoe means comprise corner fold shoes for folding said additional end wall panels upwardly relative to said side wall panels, side fold shoes for thereafter folding said side wall panels to upright positions relative to said bottom panel while continuing folding of said additional end wall panels relative to said side wall panels by said corner fold shoes, whereby said additional end wall panels swing inwardly and downwardly to upright side by side overlapping positions along the ends of said bottom panel, and center fold shoes for finally folding said first end wall panels to upright positions relative to said bottom panel.

3. The container forming machine according to claim 2 wherein:

said side fold shoes are located between said die plates and have arcuate upper ends which curve upwardly and outwardly away from said cavity in a longitudinal direction of said die plates, said corner fold shoes are located between said die plates adjacent said side fold shoes and have arcuate upper ends which curve upwardly and over said die plates, said center fold shoes are mounted on the upper edges of said die plates between the plate ends and curve outwardly away from said cavity and over the upper edges of said die plates, and the upper crests of said corner fold shoes are higher than the crests of said side fold shoes, and the crests of said side fold shoes are higher than the crests of said center fold shoes.

4. The container forming machine according to claim 3 wherein:

said actuator operating means comprise switches operable in sequence by movement of said mandrel through its forming and return strokes.

5. The container forming machine according to claim 4 wherein:

said forming machine further comprises infeed means for feeding container body blanks edgewise in succession through a gluing station to said initial forming position on said forming die, and glue applicator means at said gluing station for applying glue to selected end wall panel surfaces of each container body blank.

* * * * *